US008463607B2

(12) United States Patent
Tanaka et al.

(10) Patent No.: US 8,463,607 B2
(45) Date of Patent: Jun. 11, 2013

(54) NOISE DETECTION APPARATUS, NOISE REMOVAL APPARATUS, AND NOISE DETECTION METHOD

(75) Inventors: Masakiyo Tanaka, Kawasaki (JP); Takeshi Otani, Kawasaki (JP); Shusaku Ito, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 732 days.

(21) Appl. No.: 12/625,639

(22) Filed: Nov. 25, 2009

(65) Prior Publication Data

US 2010/0161324 A1 Jun. 24, 2010

(30) Foreign Application Priority Data

Dec. 24, 2008 (JP) ..... 2008-328380

(51) Int. Cl.
*G10L 21/02* (2006.01)

(52) U.S. Cl.
USPC ..... 704/233; 704/226

(58) Field of Classification Search
USPC ..... 704/226, 233
See application file for complete search history.

(56) References Cited

U.S. PATENT DOCUMENTS 5,029,118 A 7/1991 Nakajima et al.
5,550,924 A 8/1996 Helf et al.
7,630,396 B2 * 12/2009 Goto et al. ..... 370/464
7,890,323 B2 * 2/2011 Akamatsu ..... 704/230
2004/0122662 A1 * 6/2004 Crockett ..... 704/200.1
2008/0069364 A1 3/2008 Itou et al.
2008/0167870 A1 7/2008 Hetherington et al.
2010/0004766 A1 * 1/2010 Feng et al. ..... 700/94

FOREIGN PATENT DOCUMENTS

JP 2005-77423 A 3/2005

OTHER PUBLICATIONS

"Extended European Search Report", mailed by European Patent Office and corresponding to European application No. 09176723.6 on Mar. 16, 2010.

* cited by examiner

*Primary Examiner* — Abul Azad
(74) *Attorney, Agent, or Firm* — Fujitsu Patent Center

(57) ABSTRACT

A noise detection apparatus includes a time-frequency transform unit configured to transform an input signal from a time domain to a frequency domain to produce a spectrum, a power spectrum calculating unit configured to obtain powers of frequencies from the spectrum, a peak stationarity detecting unit configured to use peaks of the powers of frequencies in each frame to detect frequencies at which a stationary peak of the powers exists, a power stationarity detecting unit configured to use magnitudes of the powers of frequencies in each frame to detect frequencies at which the magnitudes of the powers are stationary, and a check unit configured to use the frequencies detected by the peak stationarity detecting unit and the frequencies detected by the power stationarity detecting unit to check whether there is a noise that has at least one of peak stationarity and power stationarity in the frequency domain.

9 Claims, 10 Drawing Sheets

NOISE DETECTION APPARATUS, NOISE REMOVAL APPARATUS, AND NOISE DETECTION METHOD

CROSS-REFERENCE TO RELATED APPLICATIONS

The present application is based upon and claims the benefit of priority from the prior Japanese Patent Application No. 2008-328380 filed on Dec. 24, 2008, with the Japanese Patent Office, the entire contents of which are incorporated herein by reference.

FIELD

The disclosures herein relate to a noise detection apparatus and a noise detection method for detecting dissonant noise generated in audio communications.

BACKGROUND

In audio communications, audio quality may be degraded by hum noise interfering with audio signals due to a problem with a certain circuit such as an amplifier or an AD or DA converter (e.g., an amplifier circuit is not insulated from a power supply circuit).

In order to detect hum noise, an input signal may be converted from the time domain to the frequency domain, and the presence of hum noise at a predetermined hum noise frequency is detected when a stationary peak is present at this frequency. The predetermined hum noise frequency may be 50 Hz or 60 Hz and its harmonic overtones where 50 Hz and 60 Hz correspond to the frequencies of commercial power supply in Japan.

The frequency component may not form a peak at the frequency where hum noise is supposed to produce a peak due to the mixing of interfering sounds such as voices and background noises. In such a case, hum noise may not be detected at this expected frequency.

In the following, the above-noted problem will be described in detail. FIGS. 1A through 1C are drawings illustrating examples of cases in which hum noise is not detected. As illustrated in FIGS. 1A through 1C, when the spectrum of interfering sounds is superimposed on the spectrum of hum noise, a peak at frequency A disappears at the position where the hum noise is supposed to produce a peak. In this case, a num noise component is not detected at this frequency A. When hum noise components at other frequencies are removed, an unnatural voice sound may be obtained as a result.

[Patent Document 1] Japanese Patent Application Publication No. 2005-77423

SUMMARY

According to an embodiment, a noise detection apparatus includes a time-frequency transform unit configured to transform an input signal from a time domain to a frequency domain to produce a spectrum, a power spectrum calculating unit configured to obtain powers of frequencies from the spectrum, a peak stationarity detecting unit configured to use peaks of the powers of frequencies in each frame to detect frequencies at which a stationary peak of the powers exists, a power stationarity detecting unit configured to use magnitudes of the powers of frequencies in each frame to detect frequencies at which the magnitudes of the powers are stationary, and a check unit configured to use the frequencies detected by the peak stationarity detecting unit and the frequencies detected by the power stationarity detecting unit to check whether there is a noise that has at least one of peak stationarity and power stationarity in the frequency domain.

The object and advantages of the embodiment will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

In the following, embodiments for carrying out the present invention will be described by referring to the accompanying drawings after describing the features of hum noise first.

Figure 1A:
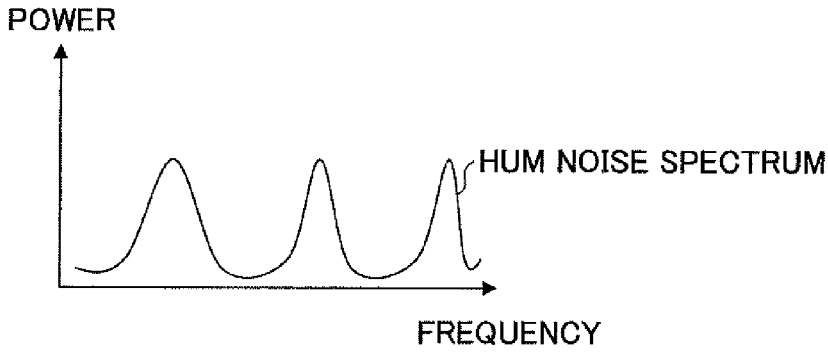
FIGS. 1A through 1C are drawings illustrating examples of cases in which hum noise is not detected.
Figure 1B:
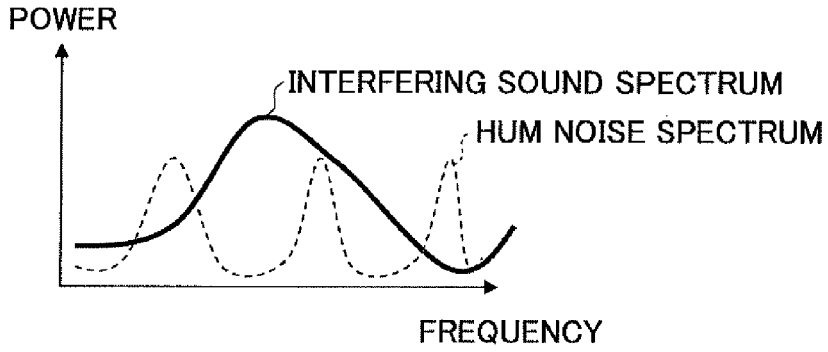
Figure 1C:
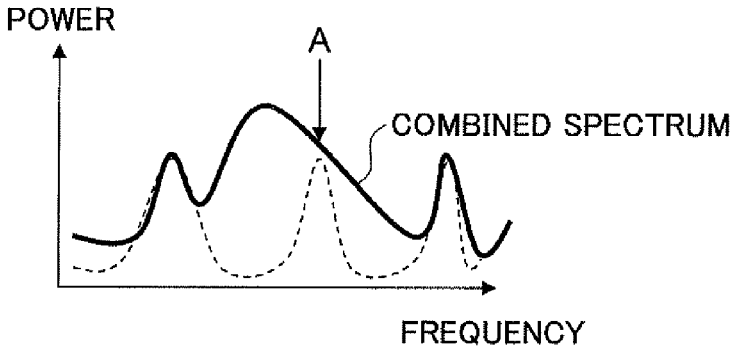
Figure 2:
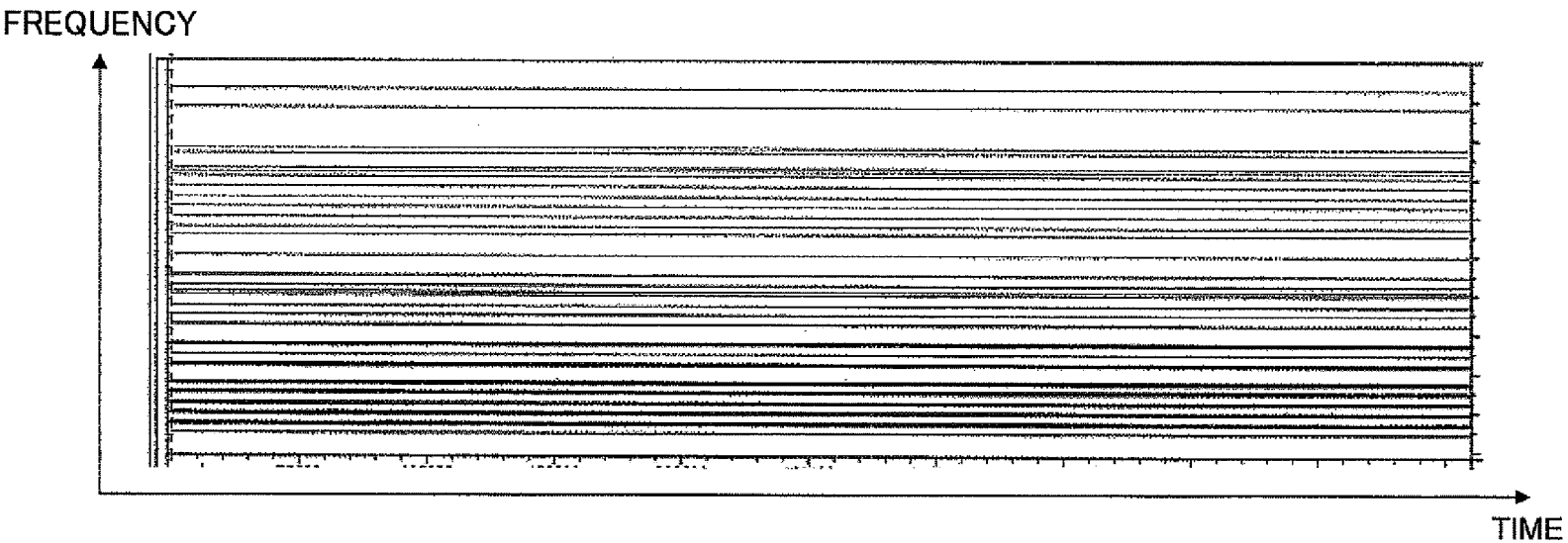
FIG. 2 is a drawing illustrating the spectrum of hum noise in the frequency domain.

FIG. 2 is a drawing illustrating the spectrum of hum noise in the frequency domain. In FIG. 2, the vertical axis represents frequency, and the horizontal axis represents time. The thickness or density of each line represents the magnitude of the power spectrum. In FIG. 2, the thicker or denser a line, the stronger the spectrum power at the corresponding frequency is. Hum noise has the following two features.

First, the peaks of hum noise are stationary regardless of the advancement of time (e.g., stationarity of peaks). This can be seen by the fact that the illustrated straight lines stay at the same frequency positions.

Second, the magnitude of frequency power spectrum at a given peak stays constant regardless of the advancement of time (e.g., stationarity of power). This can be seen in FIG. 2 by the fact that the thickness or density of a line at a given peak frequency stays almost constant. In this manner, hum noise has a plurality of frequency components each of which has a stationary peak position and stationary power in the frequency domain.

In the following, a description will be given of embodiments that utilize these two features of hum noise to detect noise (inclusive of hum noise) that has peak and power stationarity in the frequency domain.

First Embodiment

<Functional Configuration>

Figure 3:
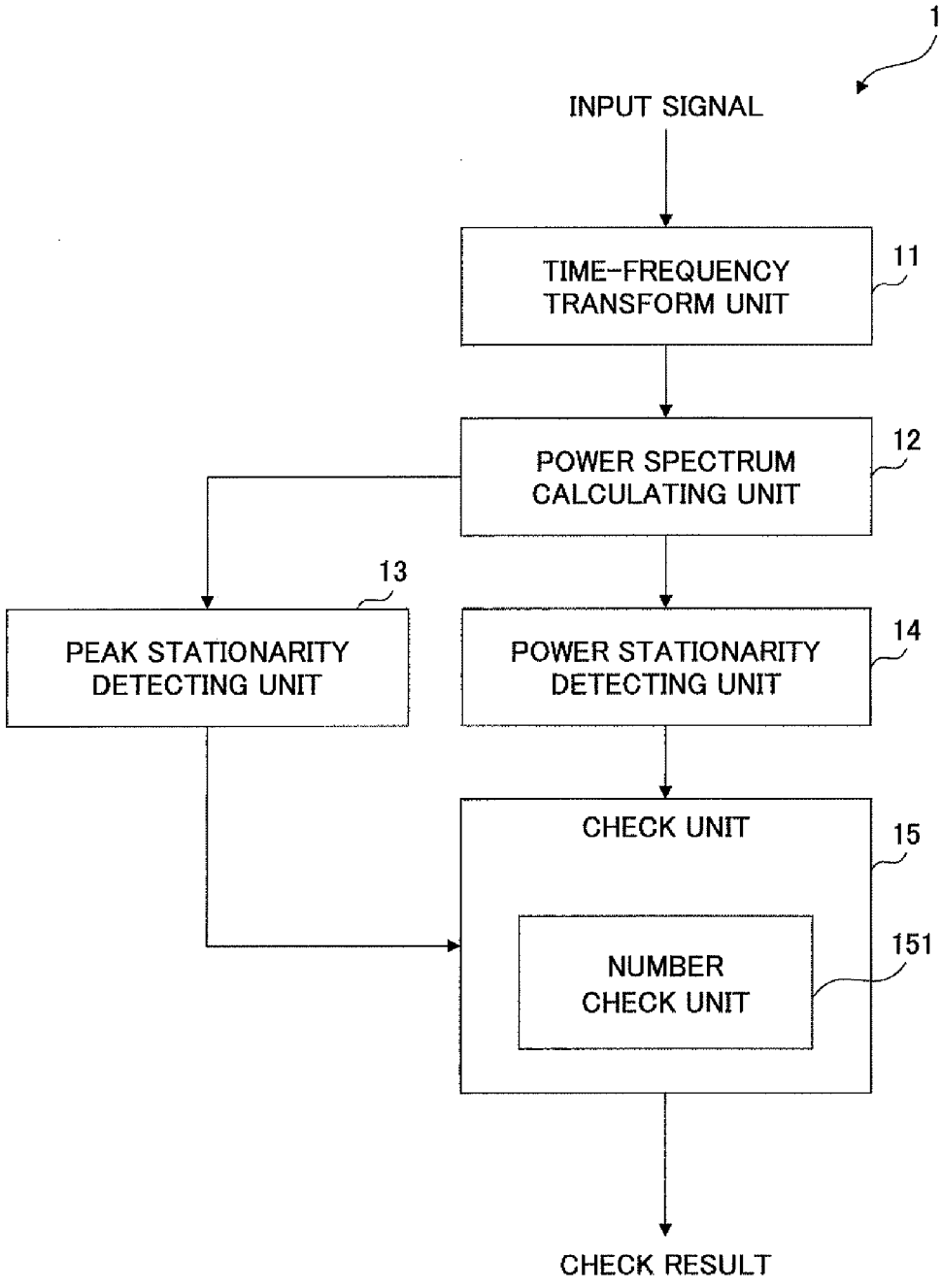
FIG. 3 is a block diagram illustrating an example of a main functional configuration of a noise detection apparatus according to a first embodiment.

FIG. 3 is a block diagram illustrating an example of a main functional configuration of a noise detection apparatus 1 according to the first embodiment. The noise detection apparatus 1 of FIG. 3 includes a time-frequency transform unit 11, a power spectrum calculating unit 12, a peak stationarity detecting unit 13, a power stationarity detecting unit 14, and a check unit 15.

The time-frequency transform unit 11 transforms an input signal from the time domain to the frequency domain on a frame-by-frame basis. The time-frequency transform may be performed by a known transform scheme such as a discrete Fourier transform (DFT) or a fast Fourier transform (FFT) that transforms a signal from the time domain to the frequency domain. The time-frequency transform unit 11 supplies the spectrum obtained by the time-frequency transform to the power spectrum calculating unit 12.

The power spectrum calculating unit 12 receives the spectrum produced by the time-frequency transform unit 11, and calculates a power spectrum from the received spectrum. The power spectrum calculating unit 12 supplies the calculated power spectrum to the peak stationarity detecting unit 13 and to the power stationarity detecting unit 14.

The peak stationarity detecting unit 13 uses the peaks of the power spectrum received from the power spectrum calculating unit 12 to identify (or detect) frequencies at which a peak of the power stays, i.e., identify (or detect) frequencies that have peak stationarity. The peak stationarity detecting unit 13 stores the power spectrum on a frame-by-frame basis. The peak stationarity detecting unit 13 detects a stationary peak if a peak appears at a given frequency in more than 50% of the frames of the stored power spectrum, for example.

The peak stationarity detecting unit 13 may select a subset of the stored power spectrum. The peak stationarity detecting unit 13 may detect a stationary peak if a peak appears at a given frequency in more than 50% of the frames of the selected subset, for example. Such a subset may correspond to 30 frames, for example. The peak stationarity detecting unit 13 supplies to the check unit 15 the detected frequencies at which the power spectrum has stationary peaks.

The peak stationarity detecting unit 13 may additionally consider the following conditions when detecting stationary peaks. For example, one such condition may stipulate that the power of a given peak is larger by X (dB: decibel) than the power of the surrounding frequencies, or is larger than Y (dBov). X may be 3, and Y may be −60, for example. This serves to remove minute peaks.

The power stationarity detecting unit 14 uses the magnitude of the power spectrum received from the power spectrum calculating unit 12 to identify (or detect) frequencies at which the magnitude of power is approximately constant, i.e., identify (or detect) frequencies that have power stationarity. The power stationarity detecting unit stores the power spectrum on a frame-by-frame basis. The power stationarity detecting unit 14 detects a stationary power if the magnitude of power at a given frequency falls within a given 5 dB range in more than 60% of the frames of the stored power spectrum, for example.

The power stationarity detecting unit 14 may select a subset of the stored power spectrum. The power stationarity detecting unit 14 may detect a stationary power if the magnitude of power at a given frequency falls within a given 5 dB range in more than 60% of the frames of the selected subset, for example. Such a subset may correspond to 30 frames, for example. The power stationarity detecting unit 14 supplies to the check unit 15 the detected frequencies at which the magnitude of power spectrum is stationary.

Figure 4:
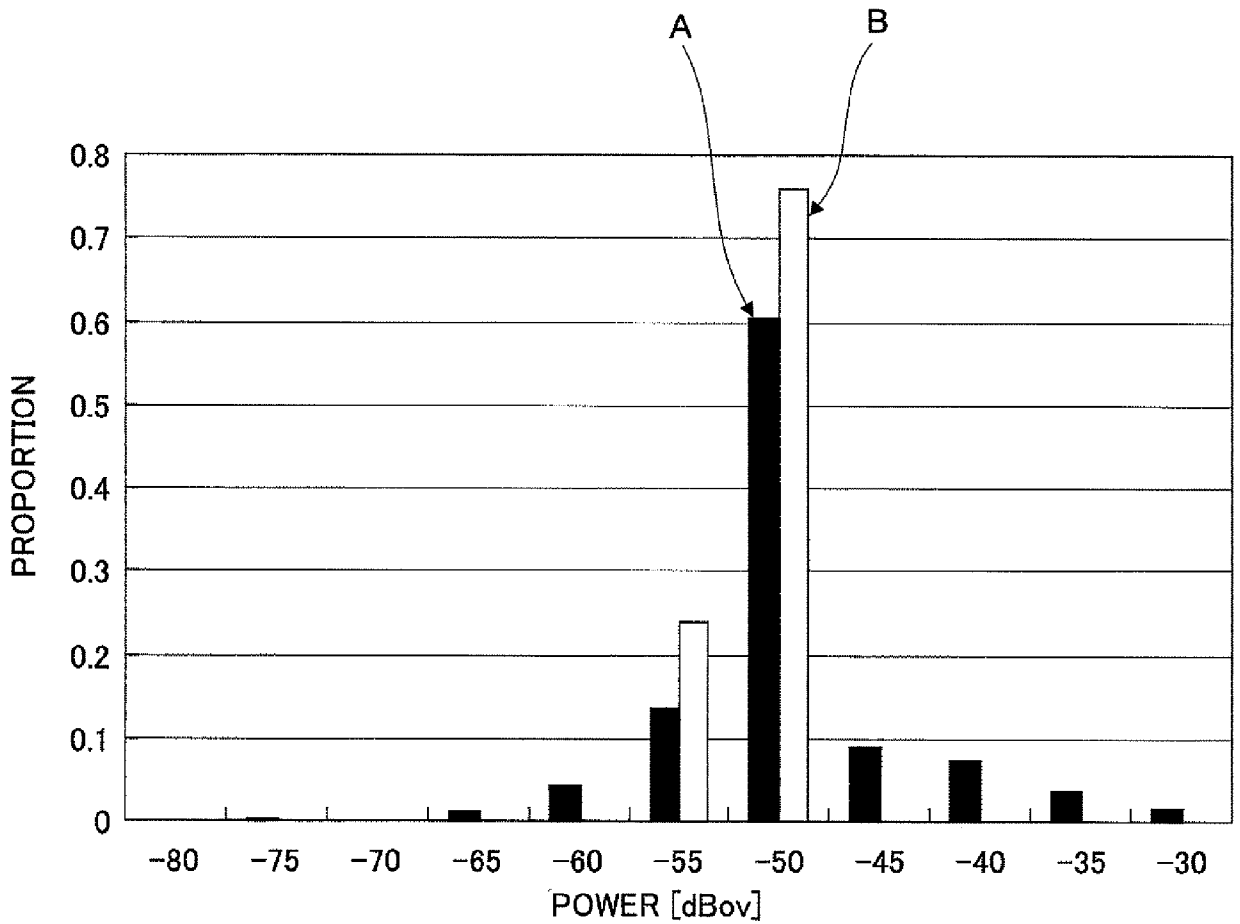
FIG. 4 is a drawing illustrating an example of a power distribution at a frequency where hum noise is present.

Power stationarity will now be described by referring to FIG. 4. FIG. 4 is a drawing illustrating an example of a power distribution at a frequency where hum noise is present. In the example illustrated in FIG. 4, solid bars A on the left represent a power distribution of a frequency component that includes hum noise and at least one of voices and background noises. Open bars B on the right represent a power distribution of a frequency component that includes only hum noise. The power axis is sectioned in units of 5 dB, and power values are tallied for each 5 dB section. Numbers (−18, −75, and so on) appearing below the power axis each indicate a representative value of each section.

As illustrated in FIG. 4, the distribution B has a strong concentration. Namely, the number of frames having a power in the −50-dBov range account for more than 70% of the frames in the selected subset. The power distribution A has a larger variance than the power distribution B, but still has a concentration. Accordingly, it is possible to check whether hum noise is present by using the concentration of a power distribution of a frequency component even if voices or background noises are mixed with the hum noise. That is, a power stationarity is detected when a concentration of the power distribution is calculated and detected to be larger than a predetermined threshold value.

The power stationarity detecting unit 14 may additionally consider the following conditions when detecting stationary power. One such condition may stipulate that the power is larger than Z (dBov), for example. Z may be −60, for example. This serves to remove minute power values.

The check unit 15 uses the frequencies received from the peak stationarity detecting unit and the frequencies received from the power stationarity detecting unit 14 to check whether there is a noise (e.g., hum noise) that has peak and power stationarity in the frequency domain. The check unit 15 includes a number check unit 151.

The number check unit 151 counts the number of frequencies detected by at least one of the peak stationarity detecting unit 13 and the power stationarity detecting unit 14, and checks whether the count exceeds a predetermined number. The predetermined number may be 10 in the case of 8-kHz sampling, for example. Provision may be made such that the frequencies detected by both the peak stationarity detecting unit 13 and the power stationarity detecting unit 14 are not counted twice.

The check unit 15 detects the presence of noise having peak and power stationarity in the frequency domain if the number check unit 151 finds that the count exceeds the predetermined number. In this case, the noise detection apparatus 1 may detect the presence of noise having peak and power stationarity in the counted frequencies. The check unit 15 detects the absence of noise having peak and power stationarity in the frequency domain if the number check unit 151 finds that the count does not exceed the predetermined number.

<Operation>

Figure 5:
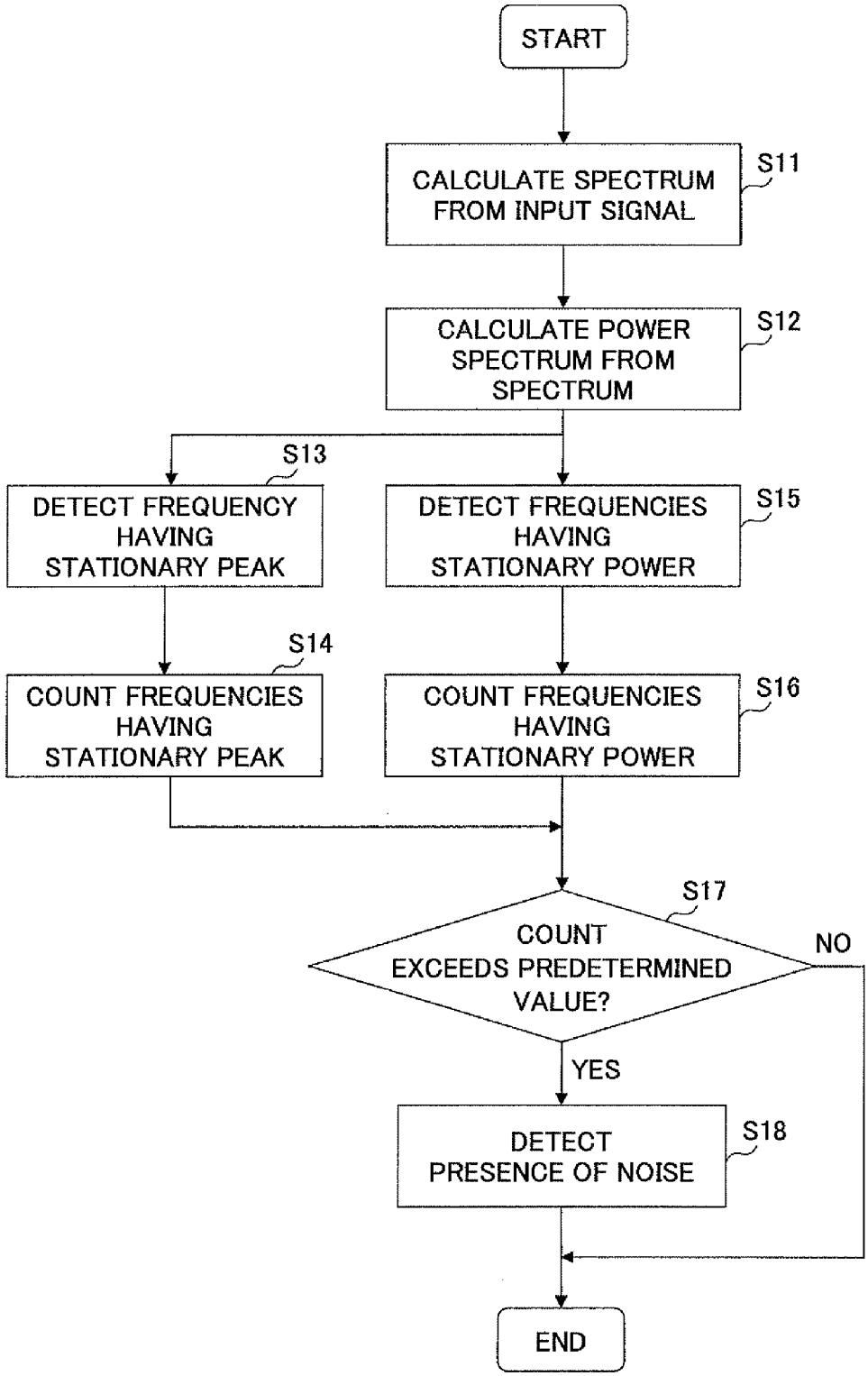
FIG. 5 is a flowchart illustrating an example of a noise detection process performed by the noise detection apparatus.

In the following, a description will be given of the operation of the noise detection apparatus 1 according to the first embodiment. FIG. 5 is a flowchart illustrating an example of a noise detection process performed by the noise detection apparatus 1.

In step S11, the time-frequency transform unit 11 calculates a spectrum by performing a time-frequency transform with respect to an input signal, followed by supplying the calculated spectrum to the power spectrum calculating unit 12.

In step S12, the power spectrum calculating unit 12 calculates a power spectrum from the supplied spectrum, and supplies the calculated power spectrum to the peak stationarity detecting unit 13 and to the power stationarity detecting unit 14.

In step S13, the peak stationarity detecting unit 13 uses the peaks of the supplied power spectrum to detect frequencies at which a stationary power peak exists. The details of how to detect such frequencies have already been described. The peak stationarity detecting unit 13 then supplies the detected frequencies to the check unit 15.

In step S14, the number check unit 151 of the check unit 15 counts the number of frequencies detected by the peak stationarity detecting unit 13.

In step S15, the power stationarity detecting unit 14 uses the power of the supplied power spectrum to detect frequencies at which the magnitude of power is stationary. The details of how to detect such frequencies have already been described. The power stationarity detecting unit 14 then supplies the detected frequencies to the check unit 15.

In step S16, the number check unit 151 of the check unit 15 counts the number of frequencies detected by the power stationarity detecting unit 14. Provision may be made such that, in step S14 and S16, the number check unit 151 of the check unit 15 does not count the same frequency twice.

In step S17, the number check unit 151 of the check unit 15 checks if the count obtained by counting is larger than a predetermined number. The procedure proceeds to step S18 if the answer to the check in step S17 is YES (i.e., the count is larger than the predetermined number). The procedure comes to an end if the answer to the check in step S17 is NO (i.e., the count is no larger than the predetermined number).

In step S18, the noise detection apparatus 1 produces an indication that noise is detected at the frequencies that contributed to the count used in step S17.

In the following, a description will be given of an experiment comparing noise detection rates between the case in which only peak stationarity is used for noise detection and the case in which peak stationarity and power stationarity are used for noise detection.

The experiment was conducted by using the following input signals.

Hum Noise

Fundamental Frequency: 50 Hz or 60 Hz

Magnitude of Power: −30 to −50 dBov on average

Interfering Noise

Noises recorded on streets, offices, train stations, etc.

The presence of hum noise was checked with respect to input signals that included the above-noted hum noise and background noises under the following conditions.

Peak Stationarity Detection

A given frequency was detected as a frequency having a stationary peak if the following two conditions were satisfied in more than 50% of the frames with respect to 30 frames (corresponding to about 4 seconds) each having a length of 128 ms:

1) the power was larger than −60 dBov; and 2) the power was at least 3 dB larger than powers of adjacent frequencies.

Power Stationarity Detection

A given frequency was detected as a frequency having a stationary power if the following two condition was satisfied in more than 60% of the frames with respect to 30 frames (corresponding to about 4 seconds) each having a length of 128 ms: the power fell within a given 5-dB range, and was larger than −60 dBov.

Check Criteria

1) Case of Using Only Peak Stationarity

The presence of hum noise was detected if a peak was present at a frequency that was an integer multiple of the fundamental frequency.

2) Case of Using Peak Stationarity and Power Stationarity

The presence of hum noise was detected when the number of frequencies detected by at least one of the peak stationarity detection and the power stationarity detection was 10 or more.

According to the experiment described above, the hum noise detection rate in the case of using only peak stationarity for the check was 79% whereas the hum noise detection rate in the case of using both the peak stationarity and the power stationarity for the check was 92%. Accordingly, a hum noise check using both peak stationarity and power stationarity improves a hum noise detection rate compared to a hum noise check using only peak stationarity. Further, the above-described experiment indicates that the noise detection apparatus 1 of the first embodiment is capable of improving a noise detection rate with respect to a noise such as hum noise that has both peak stationarity and power stationarity.

According to the first embodiment, the power spectrum of an input signal is used to detect frequencies having either peak stationarity or power stationarity, thereby improving a noise detection rate with respect to a noise that has both peak stationarity and power stationarity in the frequency domain.

Second Embodiment

In the following, a noise detection apparatus 2 according to a second embodiment will be described. In the second embodiment, a certain frequency is selected as a fundamental frequency, and frequencies that are integer multiples of the fundamental frequency are detected for the purpose of detecting the presence or absence of noise. In the second embodiment, further, only the frequencies detected among the integer multiples of the basic frequencies are counted. This improves the accuracy of noise detection with respect to a hum noise that is stationary at frequencies that are integer multiples of the fundamental frequency.

<Functional Configuration>

Figure 6:
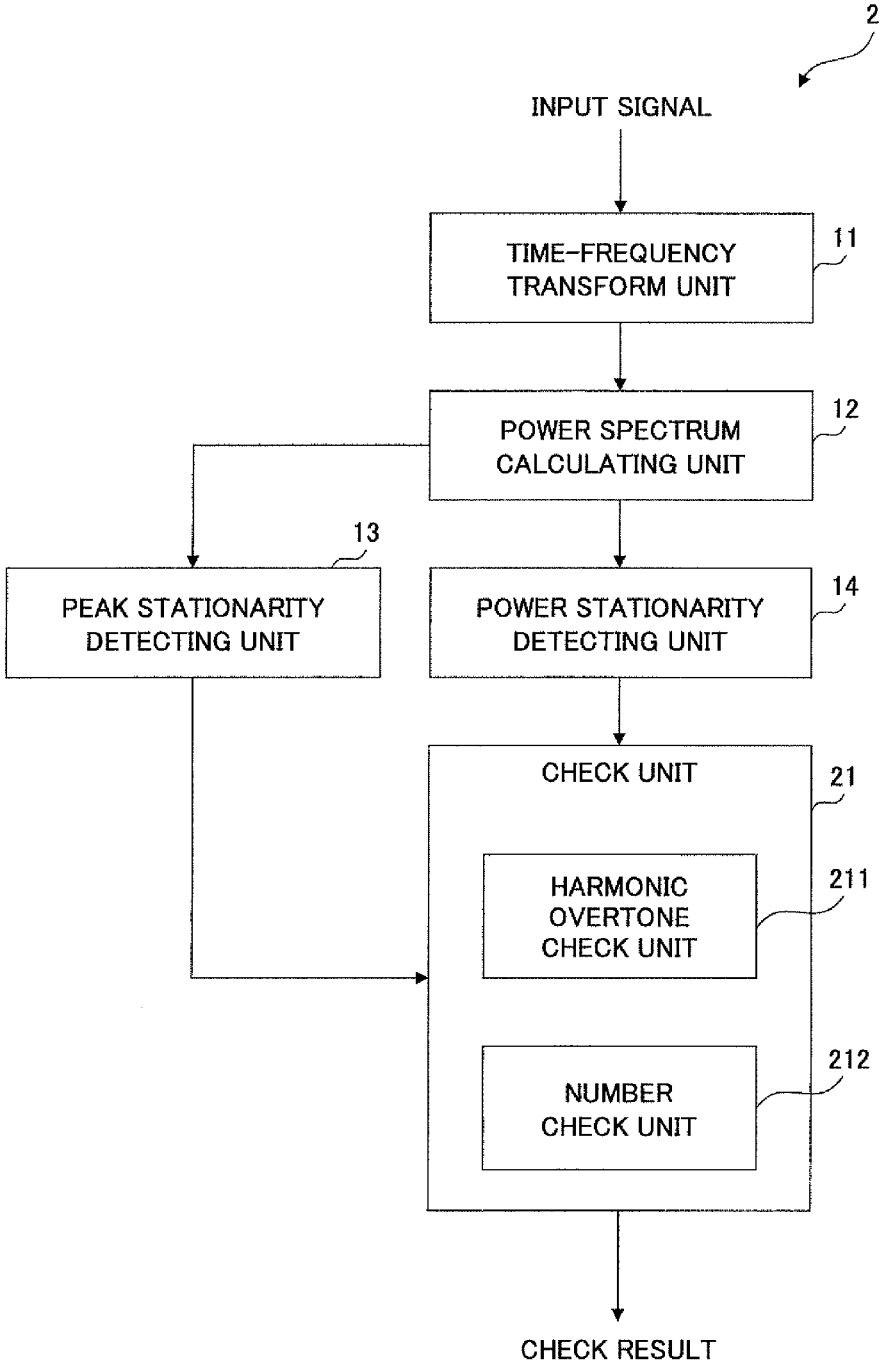
FIG. 6 is a block diagram illustrating an example of a main functional configuration of a noise detection apparatus according to a second embodiment.

FIG. 6 is a block diagram illustrating an example of a main functional configuration of a noise detection apparatus 2 according to the first embodiment. With respect to the functions illustrated in FIG. 6, the same or similar functions as those of FIG. 3 are referred to by the same numerals, and a description thereof will be omitted.

The noise detection apparatus 2 of FIG. 6 includes the time-frequency transform unit 11, the power spectrum calculating unit 12, the peak stationarity detecting unit 13, the power stationarity detecting unit 14, and a check unit 21. In the following, the check unit 21 will be described.

The check unit 21 includes a harmonic overtone check unit 211 and a number check unit 212. The harmonic overtone check unit 211 assumes a selected frequency to be a fundamental frequency. The harmonic overtone check unit 211 checks whether there is a frequency that is an integer multiple of the fundamental frequency among the frequencies detected by the peak stationarity detecting unit 13 or the power stationarity detecting unit 14. The selected frequency may be the lowest frequency among the frequencies detected by the peak stationarity detecting unit 13 or the power stationarity detecting unit 14.

In the case of detecting hum noise generated by commercial power supply or the like, the selected frequency may be at least one of 50 Hz and 60 Hz that are the frequencies of commercial power supply used in Japan. There may be a plurality of selected frequencies.

The number check unit 212 counts the number of frequencies determined to an integer multiple of the fundamental frequency by the harmonic overtone check unit 211, and checks whether the count exceeds a predetermined number. This arrangement makes it possible to more accurately detect a noise such as hum noise that has peak and power stationarity at harmonic overtones of the fundamental frequency.

<Operation>

Figure 7:
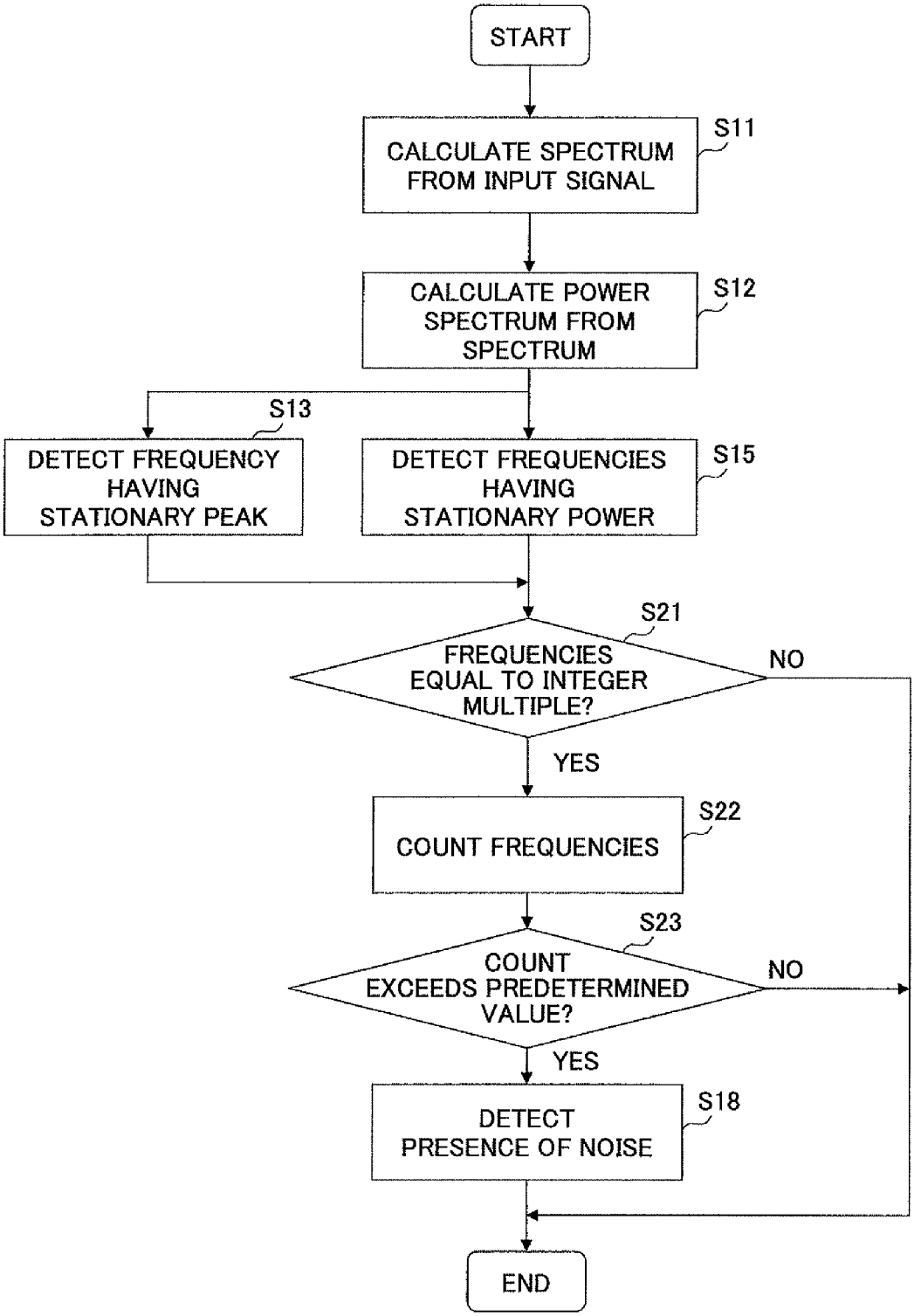
FIG. 7 is a flowchart illustrating an example of a noise detection process performed by the noise detection apparatus.

In the following, a description will be given of the operation of the noise detection apparatus 2 according to the second embodiment. FIG. 7 is a flowchart illustrating an example of a noise detection process performed by the noise detection apparatus 2. With respect to the steps illustrated in FIG. 7, the same or similar steps as those of FIG. 5 are referred to by the same numerals, and a description thereof will be omitted.

In step S21, the harmonic overtone check unit 211 of the check unit 21 checks whether there is a frequency that is an integer multiple of the fundamental frequency among the frequencies detected by the peak stationarity detecting unit 13 or the power stationarity detecting unit 14. The procedure proceeds to step S22 if the answer to the check in step S21 is YES (i.e., there is a frequency equal to an integer multiple of the fundamental frequency). The procedure comes to an end if the answer to the check in step S21 is NO (i.e., there is no frequency equal to an integer multiple of the fundamental frequency).

A proper frequency is selected in advance as the fundamental frequency. The selected frequency may be the lowest frequency among the frequencies detected by the peak stationarity detecting unit 13 or the power stationarity detecting unit 14, or may be at least one of 50 Hz and 60 Hz that are the frequencies of commercial power supply used in Japan.

In step S22, the number check unit 212 of the check unit 21 counts the number of the frequencies that are detected as an integer multiple of the fundamental frequency.

In step S23, the number check unit 212 of the check unit 21 checks if the count obtained by counting in step S22 is larger than a predetermined number. Such a predetermined number may be 10, for example. Thereafter, if the answer to the check in step S23 is YES, noise is detected at the frequencies that have contributed to the count used in the count check.

According to the second embodiment, it is possible to more accurately detect a noise such as hum noise that has peak and power stationarity at harmonic overtones of the fundamental frequency. Further, a hum noise detection rate is improved without identifying the true fundamental frequency of the noise.

The number check unit 212 may not be necessary. For example, provision may be made such that when the harmonic overtone check unit 211 detects frequencies that are an integer multiple of the fundamental frequency, such a detection alone may be treated as an indication of the presence of hum noise at these frequencies.

Third Embodiment

In the following, a noise removal apparatus 3 according to a third embodiment will be described. In the third embodiment, once noise is detected, the detected noise is removed. In the following, a description will be given of a case in which the noise detected by the check unit 15 of the first embodiment is removed. Nonetheless to say, an alternative configuration may be used in which the noise detected by the check unit 21 of the second embodiment is removed.

<Functional Configuration>

Figure 8:
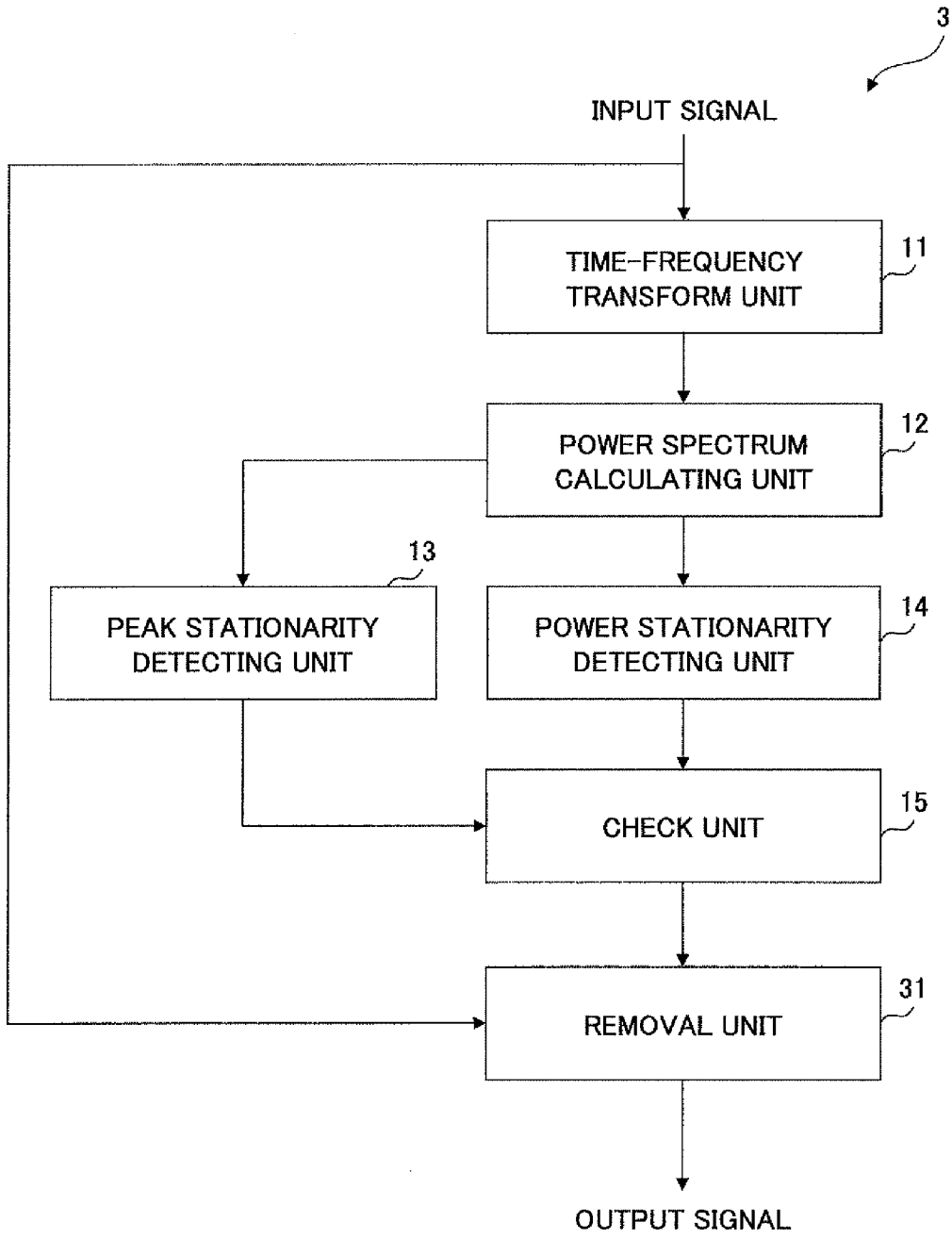
FIG. 8 is a block diagram illustrating an example of a main functional configuration of a noise removal apparatus according to a third embodiment.

FIG. 8 is a block diagram illustrating an example of a main functional configuration of a noise removal apparatus 3 according to the third embodiment. With respect to the functions illustrated in FIG. 8, the same or similar functions as those of FIG. 3 are referred to by the same numerals, and a description thereof will be omitted.

The noise removal apparatus 3 of FIG. 8 includes the time-frequency transform unit 11, the power spectrum calculating unit 12, the peak stationarity detecting unit 13, the power stationarity detecting unit 14, the check unit 15, and a removal unit 31. In the following, the removal unit 31 will be described.

The removal unit 31 synthesizes sinusoidal waves corresponding to the spectrum of the respective frequencies for which the check unit 15 has detected the presence of noise, thereby producing a noise signal in the time domain. The removal unit 31 then inverts the phase of the generated noise signal, and adds the phase-inverted signal to the input signal. As a result, an output signal in which the detected noise has been removed is obtained.

<Operation>

Figure 9:
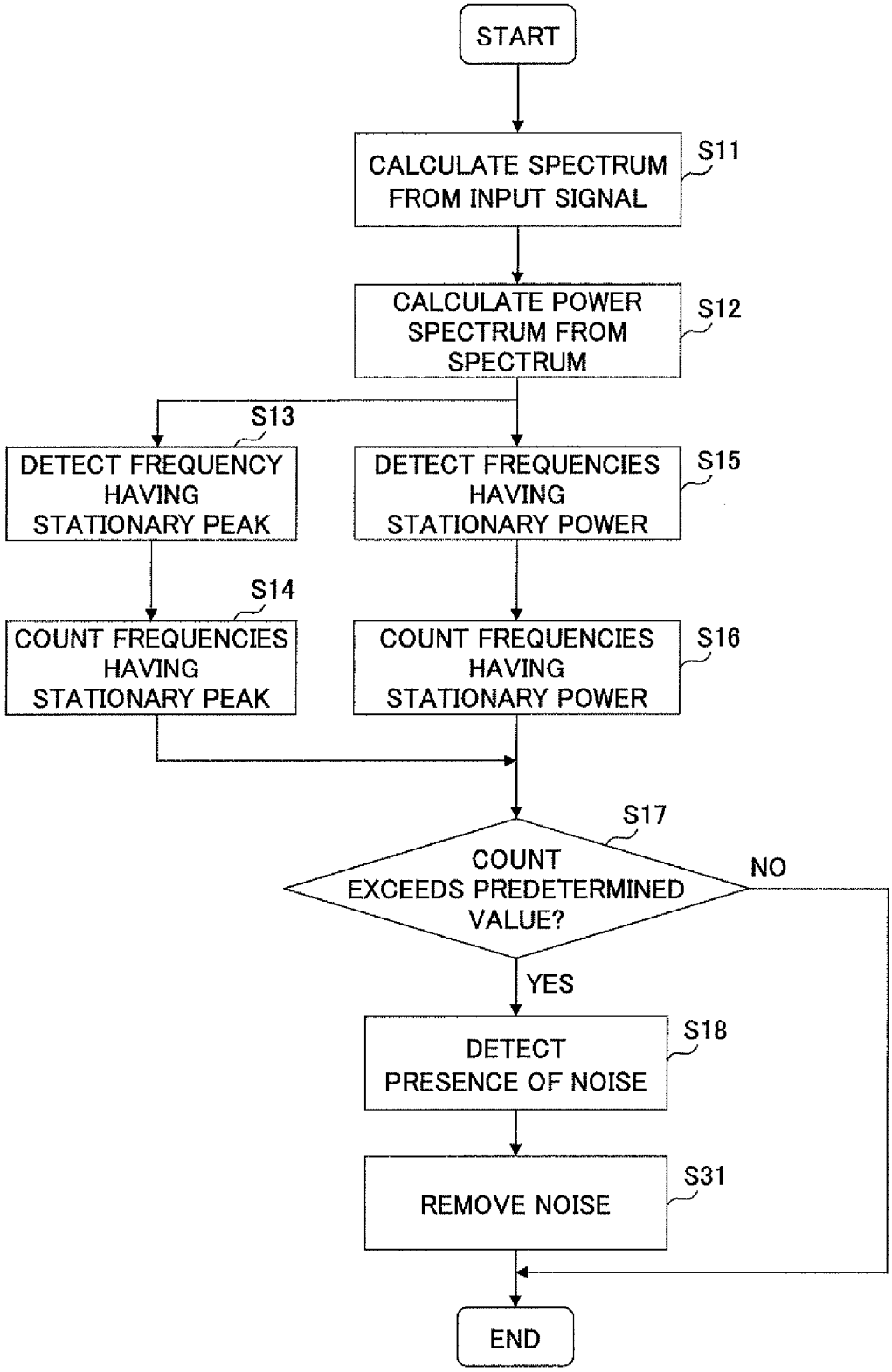
FIG. 9 is a flowchart illustrating an example of a noise removal process performed by the noise removal apparatus.

In the following, a description will be given of the operation of the noise removal apparatus 3 according to the third embodiment. FIG. 9 is a flowchart illustrating an example of a noise removal process performed by the noise removal apparatus 3. With respect to the steps illustrated in FIG. 9, the same or similar steps as those of FIG. 5 are referred to by the same numerals, and a description thereof will be omitted.

In step S31, the removal unit 31 synthesizes sinusoidal waves corresponding to the spectrum of the respective frequencies detected as noises in step S18, thereby producing a noise signal. The removal unit 31 then inverts the phase of the generated noise signal, and adds the phase-inverted signal to the input signal.

According to the third embodiment described above, an output signal in which the detected noise has been removed is obtained.

The procedure of detecting noise as described in the above-noted embodiments may be implemented as a program for causing a computer to practice the procedure. Such a program may be installed from a server or the like to a computer for execution by the computer, thereby performing the noise detection procedure.

This program may be recorded in a recording medium (e.g., CD-ROM, SD card, or the like). Such a recording medium having the program recorded therein may be read by a computer or a portable terminal, thereby performing the noise detection procedure as previously described. The recording medium may be any type of recording medium. That is, it may be a recording medium for recording information by use of an optical, electrical, or magnetic means such as a CD-ROM, a flexible disk, or a magneto-optical disk, or may be a semiconductor memory for recording information by use of an electrical means such as a ROM or a flash memory.

Figure 10:
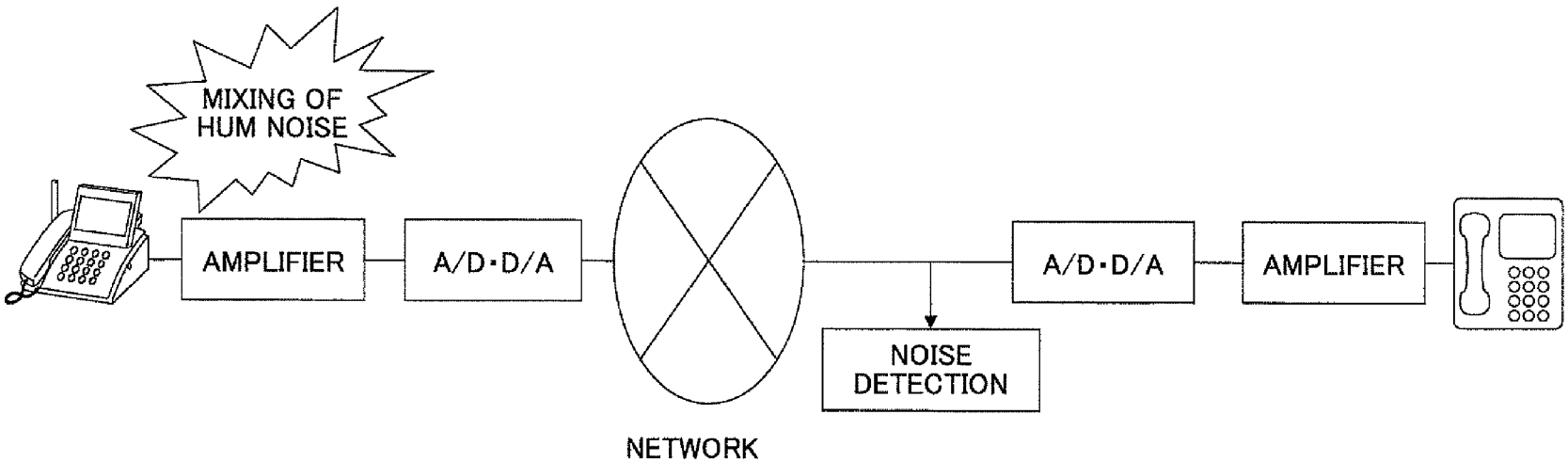
FIG. 10 is a drawing illustrating an example of an audio signal transmission system employing the noise detection apparatus.

FIG. 10 is a drawing illustrating an example of an audio signal transmission system employing the noise detection apparatus. The noise detection apparatus disclosed herein may be applied to the illustrated audio signal transmission system to accurately detect a noise such as hum noise in audio signals transmitted through a network.

According to the disclosed noise detection apparatus, the power spectrum of an input signal is used to detect frequencies having either peak stationarity or power stationarity, thereby improving a noise detection rate with respect to a noise that has both peak stationarity and power stationarity in the frequency domain.

Further, the present invention is not limited to these embodiments, but various variations and modifications may be made without departing from the scope of the present invention.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A noise detection apparatus, comprising:

a time-frequency transform unit configured to transform an input signal from a time domain to a frequency domain to produce a spectrum;

a power spectrum calculating unit configured to obtain powers of frequencies from the spectrum;

a peak stationarity detecting unit configured to use peaks of the powers of frequencies in each frame to detect frequencies at which a stationary peak of the powers exists;

a power stationarity detecting unit configured to use magnitudes of the powers of frequencies in each frame to detect frequencies at which the magnitudes of the powers are stationary; and a check unit configured to use the frequencies detected by the peak stationarity detecting unit and the frequencies detected by the power stationarity detecting unit to check whether there is a noise that has at least one of peak stationarity and power stationarity in the frequency domain by checking whether a total number of the frequencies having at least one of peak stationarity and power stationarity in the frequency domain exceeds a predetermined number.

2. The noise detection apparatus as claimed in claim 1, wherein the number checking unit is configured to count only frequencies that are an integer multiple of a predetermined frequency among the frequencies detected by at least one of the peak stationarity detecting unit and the power stationarity detecting unit.

3. The noise detection apparatus as claimed in claim 1, wherein the power stationarity detecting unit is configured to detect, as the frequencies at which the magnitudes of the powers are stationary, frequencies for each of which a distribution of a magnitude of a corresponding power has a concentration larger than a first threshold value.

4. The noise detection apparatus as claimed in claim 3, wherein the power stationarity detecting unit is configured to detect, as the frequencies at which the magnitudes of the powers are stationary, frequencies for each of which the magnitude of the corresponding power having the largest concentration in the distribution is larger than a second threshold value.

5. The noise detection apparatus as claimed in claim 1, wherein the peak stationarity detecting unit is configured to detect, as the frequencies at which a stationary peak of the powers exists, frequencies at which the powers assume a local maximum in more than a predetermined percentage of a total number of frames of interest.

6. The noise detection apparatus as claimed in claim 5, wherein the peak stationarity detecting unit is configured to detect the stationary peak that is larger by a fourth threshold value than the powers of nearby frequencies.

7. The noise detection apparatus as claimed in claim 5, wherein the peak stationarity detecting unit is configured to detect the stationary peak that is larger than a fifth threshold value.

8. A noise removal apparatus, comprising:

a time-frequency transform unit configured to transform an input signal from a time domain to a frequency domain to produce a spectrum;

a power spectrum calculating unit configured to obtain powers of frequencies from the spectrum;

a peak stationarity detecting unit configured to use peaks of the powers of frequencies in each frame to detect frequencies at which a stationary peak of the powers exists;

a power stationarity detecting unit configured to use magnitudes of the powers of frequencies in each frame to detect frequencies at which the magnitudes of the powers are stationary;

a check unit configured to use the frequencies detected by the peak stationarity detecting unit and the frequencies detected by the power stationarity detecting unit to check whether there is a noise that has at least one of peak stationarity and power stationarity in the frequency domain by checking whether a total number of the frequencies having at least one of peak stationarity and power stationarity in the frequency domain exceeds a predetermined number;

a noise removal unit configured to synthesize sinusoidal waves corresponding to the spectrum of the frequencies for which the check unit has detected presence of the noise to produce a noise signal, and to invert a phase of the produced noise signal for addition to the input signal.

9. A noise detection method, comprising:

a time-frequency transform procedure of transforming an input signal from a time domain to a frequency domain to produce a spectrum;

a power spectrum calculating procedure of obtaining powers of frequencies from the spectrum;

a peak stationarity detecting procedure of using peaks of the powers of frequencies obtained by the power spectrum calculating procedure in each frame to detect frequencies at which a stationary peak of the powers exists;

a power stationarity detecting procedure of using magnitudes of the powers of frequencies detected by the power spectrum calculating procedure in each frame to detect frequencies at which the magnitudes of the powers are stationary; and a check procedure of using the frequencies detected by the peak stationarity detecting procedure and the frequencies detected by the power stationarity detecting procedure to check whether there is a noise that has at least one of peak stationarity and power stationarity in the frequency domain by checking whether a total number of the frequencies having at least one of peak stationarity and power stationarity in the frequency domain exceeds a predetermined number.

* * * * *